US007918106B2

(12) United States Patent
Fujimoto et al.

(10) Patent No.: US 7,918,106 B2
(45) Date of Patent: Apr. 5, 2011

(54) REFRIGERATION SYSTEM

(75) Inventors: Shuuji Fujimoto, Osaka (JP); Atsushi Yoshimi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 423 days.

(21) Appl. No.: 12/084,938

(22) PCT Filed: Nov. 27, 2006

(86) PCT No.: PCT/JP2006/323576

§ 371 (c)(1),
(2), (4) Date: May 14, 2008

(87) PCT Pub. No.: WO2007/063798

PCT Pub. Date: Jun. 7, 2007

(65) Prior Publication Data

US 2009/0229300 A1 Sep. 17, 2009

(30) Foreign Application Priority Data

Nov. 30, 2005 (JP) ..... 2005-345519

(51) Int. Cl.
*F25B 43/02* (2006.01)

(52) U.S. Cl. ..... 62/470; 62/510

(58) Field of Classification Search ..... 62/470, 62/510, 193, 192, 468, 509, 512
See application file for complete search history.

(56) References Cited

U.S. PATENT DOCUMENTS

| | | | | |
|---|---|---|---|---|
| 3,719,057 | A * | 3/1973 | Grant | 62/193 |
| 4,144,002 | A * | 3/1979 | Shibuya et al. | 418/76 |
| 5,634,345 | A * | 6/1997 | Alsenz | 62/84 |
| 5,685,168 | A * | 11/1997 | Sada | 62/473 |
| 6,722,156 | B2 * | 4/2004 | Tanimoto et al. | 62/510 |
| 6,966,194 | B2 * | 11/2005 | Yokozeki et al. | 62/196.3 |
| 7,168,264 | B2 * | 1/2007 | Matsumoto et al. | 62/470 |
| 7,584,624 | B2 * | 9/2009 | Hwang et al. | 62/192 |

FOREIGN PATENT DOCUMENTS

| | | | |
|---|---|---|---|
| JP | 4-78472 | U | 7/1992 |
| JP | 2001-56157 | A | 2/2001 |
| JP | 2001-349629 | A | 12/2001 |

* cited by examiner

*Primary Examiner* — Mohammad M Ali
(74) *Attorney, Agent, or Firm* — Birch, Stewart, Kolasch & Birch, LLP

(57) ABSTRACT

A refrigerant circuit (15) is provided with a low-pressure stage oil separator (26) for separating refrigerating machine oil out of refrigerant discharged from a low-pressure stage compressor (21) and returning it to the suction side of the low-pressure stage compressor (21), and a high-pressure stage oil separator (36) for separating refrigerating machine oil out of refrigerant discharged from a high-pressure stage compressor (31) and returning it to the suction side of the high-pressure stage compressor (31). The efficiency of oil separation of the low-pressure stage oil separator (26) is set lower than that of the high-pressure stage oil separator (36).

7 Claims, 6 Drawing Sheets

REFRIGERATION SYSTEM

TECHNICAL FIELD

This invention relates to refrigeration systems including a refrigerant circuit including a gas-liquid separator and operating in a two-stage compression and two-stage expansion refrigeration cycle, and particularly relates to techniques for returning oil to a compressor of such a refrigeration system.

BACKGROUND ART

Refrigeration systems are conventionally known in which a refrigerant circuit operates in a refrigeration cycle to cool and heat a room.

Patent Document 1 discloses an air conditioning system of this kind. The air conditioning system includes a refrigerant circuit in which a high-pressure stage compressor, an indoor heat exchanger, expansion valves, an outdoor heat exchanger and a low-pressure stage compressor are connected. Also connected in the refrigerant circuit are a four-way selector valve and solenoid valves, each for selecting the flow path of refrigerant. Still also connected in the refrigerant circuit is a gas-liquid separator for separating refrigerant in a gas-liquid two-phase state into liquid refrigerant and gas refrigerant.

During a heating operation of the air conditioning system, refrigerant compressed by the high-pressure stage compressor is delivered to the indoor heat exchanger. In the indoor heat exchanger, the refrigerant releases heat to room air to condense. As a result, the room space is heated. The refrigerant having condensed in the indoor heat exchanger is reduced to an intermediate pressure by a first expansion valve and then flows into the gas-liquid separator. In the gas-liquid separator, the intermediate-pressure refrigerant in a gas-liquid two-phase state is separated into liquid refrigerant and gas refrigerant. The liquid refrigerant separated in the gas-liquid separator is reduced to a low pressure by a second expansion valve and then delivered to the outdoor heat exchanger. In the outdoor heat exchanger, the refrigerant takes heat from outdoor air to evaporate. The refrigerant having evaporated in the outdoor heat exchanger is compressed by the low-pressure stage compressor and then sent to the suction side of the high-pressure stage compressor. The refrigerant is mixed with the gas refrigerant separated in the gas-liquid separator and then further compressed by the high-pressure stage compressor.

As described so far, the above refrigerant circuit operates in a so-called two-stage compression and two-stage expansion refrigeration cycle in which a two-stage expansion of reducing the pressure of high-pressure refrigerant with two expansion valves and a two-stage compression of compressing low-pressure refrigerant with two compressors are carried out and refrigerant reduced to an intermediate pressure and separated in the gas-liquid separator is sucked into the high-pressure stage compressor.

Patent Document 1: Published Japanese Patent Application No. 2001-56159

DISCLOSURE OF THE INVENTION

Problem to Be Solved by the Invention

In the high-pressure stage and low-pressure stage compressors as described above, a refrigerating machine oil is used in order to lubricate sliding parts, such as of a compression mechanism for compressing the refrigerant. Specifically, an oil reservoir for accumulating a refrigerating machine oil therein is formed in the casing of each compressor. The refrigerating machine oil is pumped out by an oil pump mounted at the lower end of the drive shaft of the compression mechanism and thereby supplied to around the drive shaft and the sliding parts of the compression mechanism. The refrigerating machine oil supplied into the compression mechanism is discharged, together with refrigerant, from the compressor and circulates through the refrigerant circuit. Thereafter, the refrigerating machine oil is sucked, together with the refrigerant, into each compressor and used again for lubrication, such as of the compression mechanism.

However, if a two-stage compression and two-stage expansion refrigeration cycle is performed using a gas-liquid separator as in Patent Document 1, there might arise a problem of deficiency in the amount of oil returned to the high-pressure stage compressor. More specifically, since in the gas-liquid separator refrigerant in a gas-liquid two-phase state is separated into liquid refrigerant and gas refrigerant as described above, most of the refrigerating machine oil is blended in liquid refrigerant. Therefore, most of the refrigerating machine oil in the gas-liquid separator is sucked into the low-pressure stage compressor. On the other hand, since the gas refrigerant separated in the gas-liquid separator contains little refrigerating machine oil, the amount of oil returned to the high-pressure stage compressor is smaller than the amount of oil returned to the low-pressure stage compressor. As a result, the refrigerating machine oil in the high-pressure stage compressor gradually reduces and, in turn, the high-pressure stage compressor might become short of lubricant, which might increase the sliding loss of the sliding parts and cause seizure on the sliding parts.

The present invention has been made in view of the above problem and, therefore, an object thereof is that the refrigeration system including a gas-liquid separator for intermediate-pressure refrigerant and operating in a two-stage compression and two-stage expansion refrigeration cycle eliminates the deficiency in the amount of oil returned to the high-pressure stage compressor.

Means to Solve the Problem

A first aspect of the invention is directed to a refrigeration system including a refrigerant circuit (15) that includes a low-pressure stage compressor (21), a high-pressure stage compressor (31) and a gas-liquid separator (33) for intermediate-pressure refrigerant and operates in a two-stage compression and two-stage expansion refrigeration cycle. Furthermore, the refrigerant circuit (15) of the refrigeration system further includes a low-pressure stage oil separating device (26, 27, 28) for returning refrigerating machine oil separated out of refrigerant discharged from the low-pressure stage compressor (21) to the suction side of the low-pressure stage compressor (21) and a high-pressure stage oil separating device (36, 37, 38) for returning refrigerating machine oil separated out of refrigerant discharged from the high-pressure stage compressor (31) to the suction side of the high-pressure stage compressor (31), and the efficiency of oil separation of the low-pressure stage oil separating device (26, 27, 28) is set lower than that of the high-pressure stage oil separating device (36, 37, 38).

In the refrigerant circuit (15) of the refrigeration system according to the first aspect of the invention, intermediate-pressure refrigerant is separated into liquid refrigerant and gas refrigerant by the gas-liquid separator (33) and a two-stage compression and two-stage expansion refrigeration cycle is performed.

Specifically, in this refrigerant circuit, refrigerant compressed to a high pressure by the high-pressure stage compressor (31) is condensed, such as by an indoor heat exchanger, and is then reduced to an intermediate pressure and then flows into the gas-liquid separator (33). In the gas-liquid separator (33), the intermediate-pressure refrigerant in a gas-liquid two-phase state is separated into liquid refrigerant and gas refrigerant. Thereafter, the liquid refrigerant separated by the gas-liquid separator (33) is reduced to a low pressure and then evaporated, such as by an outdoor heat exchanger. Thereafter, the refrigerant is compressed to an intermediate pressure by the low-pressure stage compressor (21). The refrigerant discharged from the low-pressure stage compressor (21) is sent to the suction side of the high-pressure stage compressor (31). The refrigerant is mixed with saturated gas refrigerant separated by the gas-liquid separator (33), and then sucked into and further compressed by the high-pressure stage compressor (31).

The refrigerant circuit (15) further includes an oil separating device disposed to the discharge side of the low-pressure stage compressor (21) and an oil separating device disposed to the discharge side of the high-pressure stage compressor (31). The low-pressure stage oil separating device (26, 27, 28) separates refrigerating machine oil out of refrigerant discharged from the low-pressure stage compressor (21) and returns the separated refrigerating machine oil to the suction side of the low-pressure stage compressor (21). On the other hand, the high-pressure stage oil separating device (36, 37, 38) separates refrigerating machine oil out of refrigerant discharged from the high-pressure stage compressor (31) and returns the separated refrigerating machine oil to the suction side of the high-pressure stage compressor (31). As a result, a certain degree of refrigerating machine oil is reserved in each compressor (21, 31).

When a conventional air conditioning system operates in the above two-stage compression and two-stage expansion refrigeration cycle, most of refrigerating machine oil in refrigerant having flowed into the gas-liquid separator (33) is delivered to the low-pressure stage compressor (21), whereby the air conditioning system might be deficient in refrigerating machine oil that must be delivered to the high-pressure stage compressor (31).

To cope with the above problem, in this aspect of the invention, the efficiency of oil separation of the low-pressure stage oil separating device (26, 27, 28) is set lower than that of the high-pressure stage oil separating device (36, 37, 38). Thus, the amount of refrigerating machine oil delivered to the suction side of the high-pressure stage compressor (31) together with refrigerant passing through the low-pressure stage oil separating device (36, 37, 38) relatively increases. On the contrary, the amount of refrigerating machine oil returned from the high-pressure stage oil separating device (36, 37, 38) to the suction side of the high-pressure stage compressor (31) relatively increases. Therefore, even if the gas refrigerant sucked from the gas-liquid separator (33) into the high-pressure stage compressor (31) contains no refrigerating machine oil, the amounts of oil returned to the low-pressure stage compressor (21) and the high-pressure stage compressor (31) are easy to balance, thereby eliminating the deficiency in the amount of oil returned to the high-pressure stage compressor (31).

A second aspect of the invention is the refrigeration system according to the first aspect of the invention, wherein the high-pressure stage oil separating device includes a plurality of oil separators (36*a*, 36*b*) connected in series to the discharge side of the high-pressure stage compressor (31), and the low-pressure stage oil separating device includes a smaller number of oil separators (26) than the oil separators (36*a*, 36*b*) for the high-pressure stage compressor (31), the smaller number of oil separators (26) being connected to the discharge side of the low-pressure stage compressor (21).

In the second aspect of the invention, the refrigerant discharged from the high-pressure stage compressor (31) passes through a larger number of oil separators (36*a*, 36*b*) than the number of low-pressure stage oil separators (26) and refrigerating machine oil is thereby separated out of the refrigerant. As a result, the efficiency of oil separation of the low-pressure stage oil separating device can be easily set lower than that of the high-pressure stage oil separating device.

A third aspect of the invention is the refrigeration system according to the first aspect of the invention, wherein an oil reservoir for the refrigerating machine oil is formed in the casing of the high-pressure stage compressor (31), and the refrigerant circuit (15) further includes an oil return pipe (51) one end of which is connected to the casing of the high-pressure stage compressor (31) to open into the oil reservoir at a fixed height of the oil reservoir and the other end of which is connected to the suction side of the low-pressure stage compressor (21).

In the third aspect of the invention, an oil return pipe (51) is provided in order to maintain the oil level of the oil reservoir of the high-pressure stage compressor (31) constant. Specifically, if the efficiency of oil separation of the low-pressure stage oil separating device (26, 27, 28) is set lower than that of the high-pressure stage oil separating device (36, 37, 38), the amount of refrigerating machine oil accumulated in the oil reservoir in the casing of the high-pressure stage compressor (31) may gradually increase. In this aspect of the invention, however, excess refrigerating machine oil in the high-pressure stage compressor (31) is returned via the oil return pipe (51) to the low-pressure stage compressor (21). As a result, it can be surely avoided that the components in the high-pressure stage compressor (31) are immersed in the refrigerating machine oil.

A fourth aspect of the invention is the refrigeration system according to the first aspect of the invention, wherein an oil reservoir for the refrigerating machine oil is formed in the casing of the high-pressure stage compressor (31), and the refrigerant circuit (15) further includes an oil return pipe (51) one end of which is connected to the casing of the high-pressure stage compressor (31) to open into the oil reservoir at a fixed height of the oil reservoir and the other end of which is connected to an outflow side of the gas-liquid separator (33) through which separated liquid refrigerant flows out.

In the fourth aspect of the invention, excess refrigerating machine oil accumulated in the oil reservoir of the high-pressure stage compressor (31) is delivered to the outflow side of the gas-liquid separator (33) through which liquid refrigerant flows out. Thereafter, the refrigerating machine oil is sucked, together with the refrigerant, into the low-pressure stage compressor (21). As a result, it can be surely avoided that the components in the high-pressure stage compressor (31) are immersed in the refrigerating machine oil.

A fifth aspect of the invention is the refrigeration system according to the fourth aspect of the invention, wherein the refrigerant circuit (15) is formed by connecting an outdoor unit (20) including the low-pressure stage compressor (21) and an outdoor heat exchanger (22), an indoor unit (40) including an indoor heat exchanger (41), and an option unit (30) including the high-pressure stage compressor (31), the gas-liquid separator (33) and the oil return pipe (51) to each other by piping.

In the fifth aspect of the invention, the refrigerant circuit (15) in the fourth aspect of the invention is formed by connecting an option unit (30) to the outdoor unit (20) and the indoor unit (40). In such a case, in order that the oil return pipe (51) connected at the inflow end to the high-pressure stage compressor (31) is connected at the outflow end to the suction side of the low-pressure stage compressor (21) as in the third aspect of the invention, it is necessary to connect a part of the oil return pipe (51) located in the option unit (30) to another part thereof located in the outdoor unit (20) and to thereby provide a connection pipe between both the parts of the oil return pipe (51). This complicates the configuration of the refrigerant circuit (15) and the piping work.

In contrast, in this aspect of the invention, the entire refrigerant path until excess refrigerating machine oil in the high-pressure stage compressor (31) is delivered via the oil return pipe (51) to the outflow side of the gas-liquid separator (33) is completed within the option unit (30). This simplifies the configuration of the refrigerant circuit (15), facilitates the piping work and provides a refrigeration system operating in a two-stage compression and two-stage expansion refrigeration cycle without modifying the existing outdoor unit (20).

EFFECTS OF THE INVENTION

According to the present invention, since the efficiency of oil separation of the high-pressure stage oil separating device (36, 37, 38) is set lower than that of the low-pressure stage oil separating device (26, 27, 28), this eliminates the deficiency in the amount of oil returned to the high-pressure stage compressor (31) during a two-stage compression and two-stage expansion refrigeration cycle using the gas-liquid separator (33). Therefore, the sliding parts of the high-pressure stage compressor (31) can be surely lubricated, which avoids seizure and wear of the sliding parts and reduction in compression efficiency due to increase in sliding loss.

In the second aspect of the invention, the number of low-pressure stage oil separators (26) is smaller than that of high-pressure stage oil separators (36*a*, 36*b*). As a result, the efficiency of oil separation of the low-pressure stage oil separating device (26, 27, 28) can be easily and surely set lower than that of the high-pressure stage oil separating device (36*a*, 36*b*, 37, 38).

In the third and fourth aspects of the invention, excess refrigerating machine oil accumulated in the oil reservoir of the high-pressure stage compressor (31) is returned to the suction side of the low-pressure stage compressor (21). As a result, it can be surely avoided that the components in the high-pressure stage compressor (31) are immersed in the refrigerating machine oil because of rise in the oil level in the high-pressure stage compressor (31).

In the fifth aspect of the invention, each of the outdoor unit (20), the indoor unit (40) and the option unit (30) is formed as a unit. Therefore, by adding the option unit (30) to a separate type refrigeration system composed of existing outdoor unit (20) and indoor unit (40) and operating in a single compression stage refrigeration cycle with a single compressor (21), a refrigeration system operable in a two-stage compression and two-stage expansion refrigeration cycle can be configured.

Since in this case the refrigerant path until the return of excess refrigerating machine oil in the high-pressure stage compressor (31) to the gas-liquid separator (33) is completed within the option unit (30), this simplifies the piping configuration for the oil return pipe (51). Therefore, in adding an option unit (30) to the existing outdoor unit (20) and indoor unit (40), the piping work can be simplified.

LIST OF REFERENCE NUMERALS

Figure 1:
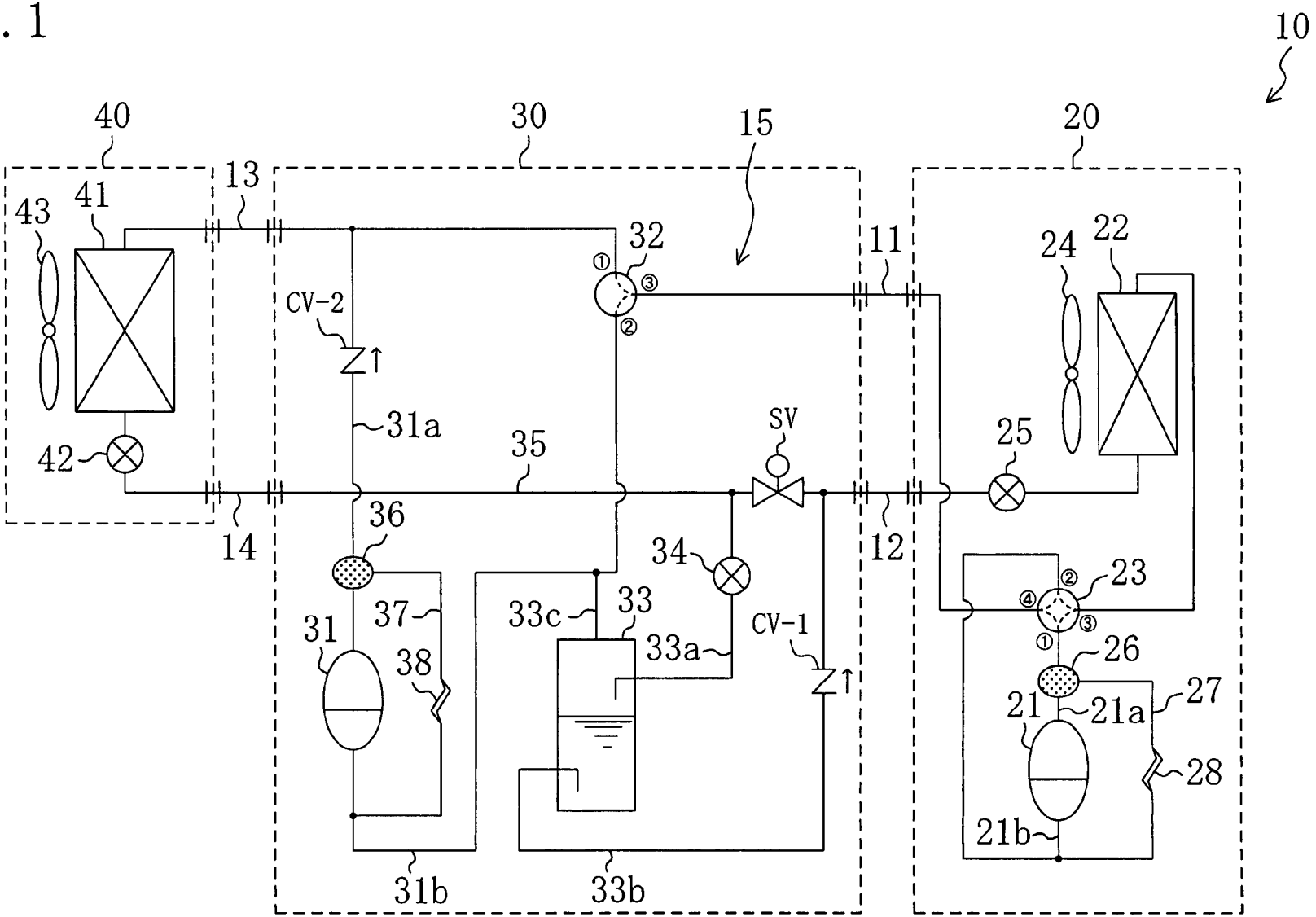
FIG. 1 is a piping diagram showing a refrigerant circuit of a refrigeration system according to Embodiment 1.

10 air conditioning system (refrigeration system)
15 refrigerant circuit
20 outdoor unit
21 low-pressure stage compressor
22 outdoor heat exchanger
26 low-pressure stage oil separator (low-pressure stage oil separating device)
30 option unit
31 high-pressure stage compressor
36 high-pressure stage oil separator (high-pressure stage oil separating device)
40 indoor unit
41 indoor heat exchanger

BEST MODE FOR CARRYING OUT THE INVENTION

Embodiments of the present invention will be described below in detail with reference to the drawings.

Embodiment 1 of the Invention

A description is given of Embodiment 1 of the invention. The refrigeration system of Embodiment 1 constitutes a heat pump air conditioning system (10) capable of a cooling operation and a heating operation. As shown in FIG. 1, the air conditioning system (10) includes an outdoor unit (20) placed outdoors, an option unit (30) constituting an expansion unit, and an indoor unit (40) placed in a room. The outdoor unit (20) constitutes a heat source side unit and is connected via a first connection pipe (11) and a second connection pipe (12) to the option unit (30). The indoor unit (40) constitutes a utilization side unit and is connected via a third connection pipe (13) and a fourth connection pipe (14) to the option unit (30). As a result, in this air conditioning system (10), a refrigerant circuit (15) operating in a vapor compression refrigeration cycle by circulating refrigerant therethrough is constituted.

The option unit (30) constitutes a power-up unit for an existing separate-type air conditioning system. Specifically, in existing air conditioning systems, a refrigerant circuit composed of an outdoor unit (20) and an indoor unit (40) operates in a single compression stage refrigeration cycle. On the other hand, in this air conditioning system (10), the refrigerant circuit (15) can operate in a two-stage compression and two-stage expansion refrigeration cycle, though described later in detail, by connecting the option unit (30) between the outdoor unit (20) and the indoor unit (40).

<Outdoor Unit>

The outdoor unit (20) includes a low-pressure stage compressor (21), an outdoor heat exchanger (22), an outdoor expansion valve (25) and a four-way selector valve (23).

The low-pressure stage compressor (21) is constituted by a high-pressure domed, variable displacement, scroll compressor. The outdoor heat exchanger (22) is a heat-source side heat exchanger and is constituted by a cross-fin-and-tube heat exchanger. Disposed close to the outdoor heat exchanger (22) is an outdoor fan (24). The outdoor fan (24) delivers outdoor air to the outdoor heat exchanger (22). The outdoor expansion valve (25) is composed of an electronic expansion valve controllable in opening.

The four-way selector valve (23) has first to fourth ports. In the four-way selector valve (23), the first port is connected to a discharge pipe (21*a*) of the low-pressure stage compressor (21) and the second port is connected to a suction pipe (21*b*) thereof. Furthermore, in the four-way selector valve (23), the third port is connected via the outdoor heat exchanger (22) and the outdoor expansion valve (25) to the second connection pipe (12) and the fourth port is connected to the first connection pipe (11). The four-way selector valve (23) is configured to be switchable between a position in which the first and third ports are communicated with each other and the second and fourth ports are communicated with each other and another position in which the first and fourth ports are communicated with each other and the second and third ports are communicated with each other.

The outdoor unit (20) also includes a low-pressure stage oil separator (26) disposed in the discharge pipe (21*a*) of the low-pressure stage compressor (21). The low-pressure stage oil separator (26) is connected to one end of a first oil separation pipe (27) through which refrigerating machine oil after being separated flows. The other end of the first oil separation pipe (27) is connected to the suction pipe (21*b*) of the low-pressure stage compressor (21). The first oil separation pipe (27) is also connected to a first capillary tube (28) for reducing the pressure of the refrigerating machine oil returning to the suction side. Thus, the low-pressure stage oil separator (26), the first oil separation pipe (27) and the first capillary tube (28) constitutes a low-pressure stage oil separating device for returning the refrigerating machine oil, which has been separated out of the refrigerant discharged from the low-pressure stage compressor (21), to the suction side of the low-pressure stage compressor (21).

<Option Unit>

The option unit (30) includes a high-pressure stage compressor (31), a three-way selector valve (32), a gas-liquid separator (33) and an option side expansion valve (34). The high-pressure stage compressor (31) is constituted by a high-pressure domed, variable displacement, scroll compressor.

The three-way selector valve (32) has first to third ports. In the three-way selector valve (32), the first port is connected to a discharge pipe (31*a*) of the high-pressure stage compressor (31), the second port is connected to a suction pipe (31*b*) of the high-pressure stage compressor (31) and the third port is connected to the first connection pipe (11). The three-way selector valve (32) is configured to be switchable between a position in which the first and third ports are communicated with each other and another position in which the second and third ports are communicated with each other.

The gas-liquid separator (33) is for the purpose of separating refrigerant in a gas-liquid two-phase state into liquid refrigerant and gas refrigerant. Specifically, the gas-liquid separator (33) is formed of a cylindrical hermetic vessel and includes a liquid refrigerant reservoir formed in a lower part thereof and a gas refrigerant reservoir formed above the liquid refrigerant reservoir. The gas-liquid separator (33) is connected to a first pipe (33*a*) passing through the sidewall thereof and opening into the gas refrigerant reservoir and a second pipe (33*b*) passing through the sidewall thereof and opening into the liquid refrigerant reservoir. The gas-liquid separator (33) is also connected to a third pipe (33*c*) passing through the top thereof and opening into the gas refrigerant reservoir.

The inflow end of the first pipe (33*a*) and the outflow end of the second pipe (33*b*) are connected to a main pipe (35) extending between the second connection pipe (12) and the fourth connection pipe (14). The first pipe (33*a*) is provided with the option side expansion valve (34). The option side expansion valve (34) is composed of an electronic expansion valve controllable in opening. The outflow end of the third pipe (33*c*) is connected to the suction pipe (31*b*) of the high-pressure stage compressor (31).

The option unit (30) also includes a solenoid valve for selectively opening and closing the flow path and check valves for restricting the refrigerant flow. Specifically, the main pipe (35) has a solenoid valve (SV) disposed between the connecting part with the first pipe (33*a*) and the connecting part with the second pipe (33*b*). Furthermore, the second pipe (33*b*) is provided with a first check valve (CV-1) and the discharge pipe (31*a*) of the high-pressure stage compressor (31) is provided with a second check valve (CV-2). Each of the first and second check valves (CV-1, CV-2) allows only a refrigerant flow in the direction shown in the arrow in FIG. 1.

The option unit (30) also includes a high-pressure stage oil separator (36) disposed in the discharge pipe (31*a*) of the high-pressure stage compressor (31). The high-pressure stage oil separator (36) is connected to one end of a second oil separation pipe (37) through which refrigerating machine oil after being separated flows. The other end of the second oil separation pipe (37) is connected to the suction pipe (31*b*) of the high-pressure stage compressor (31). The second oil separation pipe (37) is also connected to a second capillary tube (38) for reducing the pressure of the refrigerating machine oil returning to the suction side. Thus, the high-pressure stage oil separator (36), the second oil separation pipe (37) and the second capillary tube (38) constitutes a high-pressure stage oil separating device for returning the refrigerating machine oil, which has been separated out of the refrigerant discharged from the high-pressure stage compressor (31), to the suction side of the high-pressure stage compressor (31).

<Indoor Unit>

The indoor unit (40) includes an indoor heat exchanger (41) and an indoor expansion valve (42). The indoor heat exchanger (41) is a utilization side heat exchanger and is constituted by a cross-fin-and-tube heat exchanger. Disposed close to the indoor heat exchanger (41) is an indoor fan (43). The indoor fan (43) delivers room air to the indoor heat exchanger (41). The indoor expansion valve (42) is composed of an electronic expansion valve controllable in opening.

<Performance of Oil Separator>

As a feature of the present invention, the efficiency of oil separation (rate of refrigerating machine oil separated out of discharged refrigerant) of the low-pressure stage oil separating device in the outdoor unit (20) is set lower than that of the high-pressure stage oil separating device in the option unit (30). Specifically, the low-pressure stage oil separator (26) is constituted by a cyclone oil separator with a relatively low efficiency of oil separation and actually has an efficiency of oil separation of approximately 90%. On the other hand, the high-pressure stage oil separator (36) is constituted by a demister oil separator with a relatively high efficiency of oil separation and actually has an efficiency of oil separation of approximately 95%. Therefore, in the refrigerant circuit (15), the refrigerating machine oil is more actively recovered and more returned to the suction side from refrigerant discharged by the high-pressure stage compressor (31) than from refrigerant discharged by the low-pressure stage compressor (21).

—Operational Behavior—

Next, a description is given of the operational behavior of the air conditioning system (10) of Embodiment 1.

<Cooling Operation>

Figure 2:
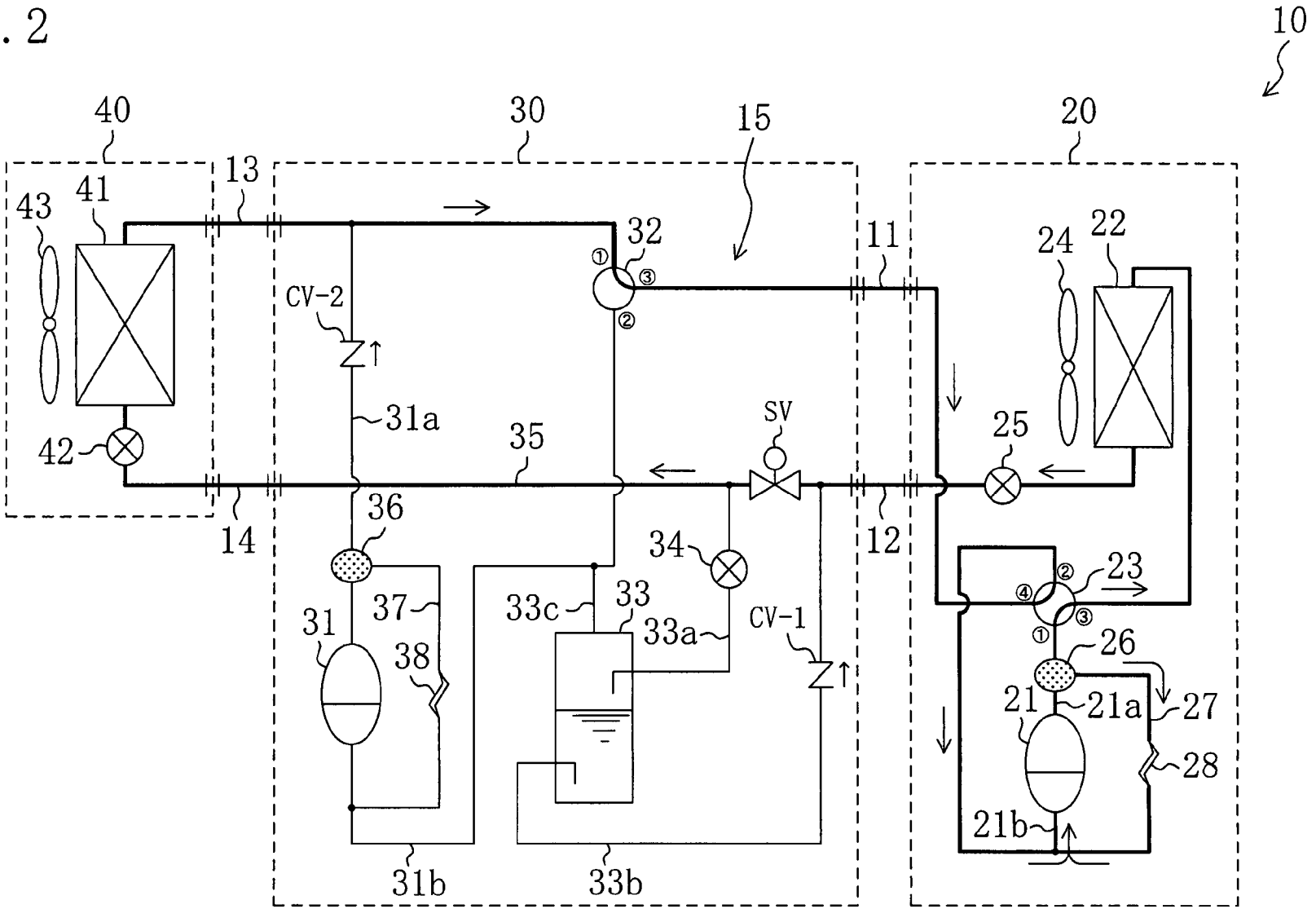
FIG. 2 is a piping diagram showing a refrigerant flow during a cooling operation.

In the cooling operation, the four-way selector valve (23) and the three-way selector valve (32) are selected to their respective positions shown in FIG. 2 and the solenoid valve (SV) is selected to its open position. Furthermore, the outdoor expansion valve (25) and the option side expansion valve (34) are selected to fully open and fully closed positions, respectively, and the opening of the indoor expansion valve (42) is appropriately controlled according to the operating conditions. Furthermore, in the cooling operation, the low-pressure stage compressor (21) is driven while the high-pressure stage compressor (31) is shut off. In other words, the refrigerant circuit (15) during the cooling operation compresses refrigerant only in the low-pressure stage compressor (21) to operate in a single compression stage refrigeration cycle.

The refrigerant discharged from the low-pressure stage compressor (21) in the outdoor unit (20) flows through the outdoor heat exchanger (22). In the outdoor heat exchanger (22), high-pressure refrigerant releases heat to outdoor air to condense. The refrigerant having condensed in the outdoor heat exchanger (22) is delivered via the main pipe (35) of the option unit (30) to the indoor unit (40).

The refrigerant having flowed into the indoor unit (40) is reduced to a low pressure during passage through the indoor expansion valve (42). The low-pressure refrigerant obtained by pressure reduction flows through the indoor heat exchanger (41). In the indoor heat exchanger (41), the refrigerant takes heat from room air to evaporate. As a result, the room air is cooled to cool the room space. The refrigerant having evaporated in the indoor heat exchanger (41) is delivered to the outdoor unit (20). The refrigerant having flowed into the outdoor unit (20) is sucked into the low-pressure stage compressor (21).

Furthermore, during the cooling operation, the low-pressure stage oil separator (26) separates refrigerating machine oil out of the refrigerant discharged from the low-pressure stage compressor (21). The refrigerating machine oil flows through the first oil separation pipe (27), is then reduced in pressure by the first capillary tube (28) and then sucked into the low-pressure stage compressor (21). As a result, the refrigerating machine oil discharged from the low-pressure stage compressor (21) is returned to the low-pressure stage compressor (21). This avoids the deficiency in refrigerating machine oil that must be supplied to the sliding parts in the low-pressure stage compressor (21).

<Heating Operation>

Figure 3:
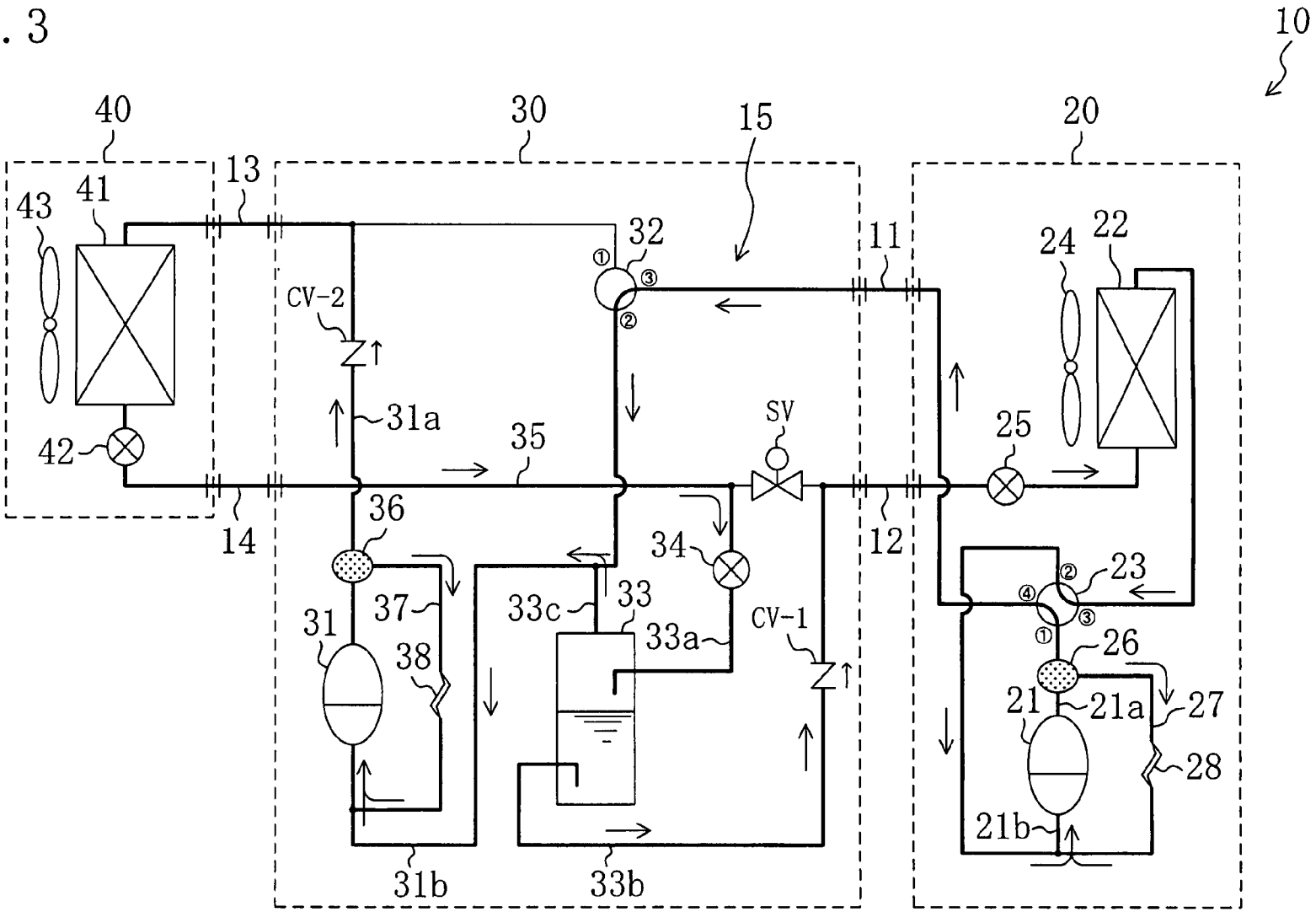
FIG. 3 is a piping diagram showing a refrigerant flow during a heating operation.

In the heating operation, the four-way selector valve (23) and the three-way selector valve (32) are selected to their respective positions shown in FIG. 3 and the solenoid valve (SV) is selected to its closed position. Furthermore, the openings of the indoor expansion valve (42), the option side expansion valve (34) and the outdoor expansion valve (25) are appropriately controlled according to the operating conditions. Furthermore, in the heating operation, the low-pressure stage compressor (21) and the high-pressure stage compressor (31) are both driven.

The refrigerant discharged from the high-pressure stage compressor (31) in the option unit (30) flows through the indoor heat exchanger (41) in the indoor unit (40). In the indoor heat exchanger (41), high-pressure refrigerant releases heat to room air to condense. As a result, the room air is heated to heat the room space. The refrigerant having condensed in the indoor heat exchanger (41) is reduced to an intermediate pressure by the indoor expansion valve (42) and the option side expansion valve (34) and then flows via the first pipe (33*a*) into the gas-liquid separator (33).

In the gas-liquid separator (33), the intermediate-pressure refrigerant in a gas-liquid two-phase state is separated into gas refrigerant and liquid refrigerant. The separated gas refrigerant in a saturated state is sent to the suction side of the high-pressure stage compressor (31). On the other hand, the separated liquid refrigerant flows out through the second pipe (33*b*). The refrigerant is reduced to a low pressure during passage through the outdoor expansion valve (25) in the outdoor unit (20). The refrigerant reduced to the low pressure flows through the outdoor heat exchanger (22). In the outdoor heat exchanger (22), the refrigerant takes heat from outdoor air to evaporate. The refrigerant having evaporated in the outdoor heat exchanger (22) is sucked into the low-pressure stage compressor (21).

In the low-pressure stage compressor (21), the refrigerant reduced to the low pressure is compressed to an intermediate pressure. The refrigerant increased to the intermediate pressure is delivered to the option unit (30) again. The refrigerant having flowed into the option unit (30) is mixed with the gas refrigerant separated by the gas-liquid separator (33), and then sucked into the high-pressure stage compressor (31).

As described so far, the air conditioning system in the heating operation operates in a two-stage compression and two-stage expansion refrigeration cycle in which high-pressure refrigerant is expanded in two stages, low-pressure refrigerant is compressed in two stages, intermediate-pressure refrigerant in a gas-liquid two-phase state is separated into gas refrigerant and liquid refrigerant by the gas-liquid separator (33) and the separated gas refrigerant is returned to the high-pressure stage compressor (31).

When conventional air conditioning systems operate in a two-stage compression and two-stage expansion refrigeration cycle using a gas-liquid separator in the above manner, they might cause a problem of deficiency in refrigerating machine oil in the high-pressure stage compressor. More specifically, in the gas-liquid separator, most of refrigerating machine oil is blended in liquid refrigerant but little is blended in gas refrigerant. Therefore, most of the refrigerating machine oil in the refrigerant having flowed into the gas-liquid separator is delivered to the low-pressure stage compressor. As a result, the amount of refrigerating machine oil returned to the high-pressure stage compressor is likely to be insufficient in comparison with the amount of refrigerating machine oil returned to the low-pressure stage compressor. Therefore, the conventional air conditioning systems might cause poor lubrication on the sliding parts of the high-pressure stage compressors, resulting in increased sliding loss, seizure and wear of the sliding parts.

To eliminate the above problem, in the air conditioning system (10) of this embodiment, the efficiency of oil separation of the low-pressure stage oil separator (26) is set lower than that of the high-pressure stage oil separator (36).

Specifically, although the liquid refrigerant after being separated by the gas-liquid separator (33) is sucked, with a large amount of refrigerating machine oil contained therein, into the low-pressure stage compressor (21), the amount of refrigerating machine oil separated out of refrigerant discharged from the low-pressure stage compressor (21) by the low-pressure stage oil separator (26) reduces in comparison with the high-pressure stage oil separator (36). Therefore, the amount of refrigerating machine oil returned via the first oil separation pipe (27) to the low-pressure stage compressor (21) relatively reduces, while the amount of refrigerating machine oil passing through the low-pressure stage oil separator (26) together with refrigerant relatively increases. Thus, the amount of refrigerating machine oil in the refrigerant afterward delivered to the high-pressure stage compressor (31) also increases.

On the contrary, the amount of refrigerating machine oil separated by the high-pressure stage oil separator (36) increases in comparison with the low-pressure stage oil separator (26). Therefore, the amount of refrigerating machine oil returned via the second oil separation pipe (37) to the high-pressure stage compressor (31) relatively increases, and the amount of refrigerating machine oil passing through the high-pressure stage oil separator (36) together with refrigerant relatively increases.

In the above manner, the air conditioning system (10) of this embodiment actively returns refrigerating machine oil to the high-pressure stage compressor (31). Therefore, even if the air conditioning system (10) during a heating operation operates in a two-stage compression and two-stage expansion refrigeration cycle, the deficiency in refrigerating machine oil in the high-pressure stage compressor (31) can be avoided.

Effects of Embodiment 1

In Embodiment 1, the low-pressure stage oil separator (26) and the high-pressure stage oil separator (36) are constituted by a cyclone oil separator and a demister oil separator, respectively, whereby the efficiency of oil separation of the low-pressure stage oil separating device (26, 27, 28) is set lower than that of the high-pressure stage oil separating device (36, 37, 38). This eliminates the deficiency in the amount of oil returned to the high-pressure stage compressor (31) during a heating operation in a two-stage compression and two-stage expansion refrigeration cycle. Therefore, the sliding parts of the high-pressure stage compressor (31) can be surely lubricated, which avoids seizure and wear of the sliding parts and reduction in compression efficiency due to increase in sliding loss.

Modification of Embodiment 1

Figure 4:
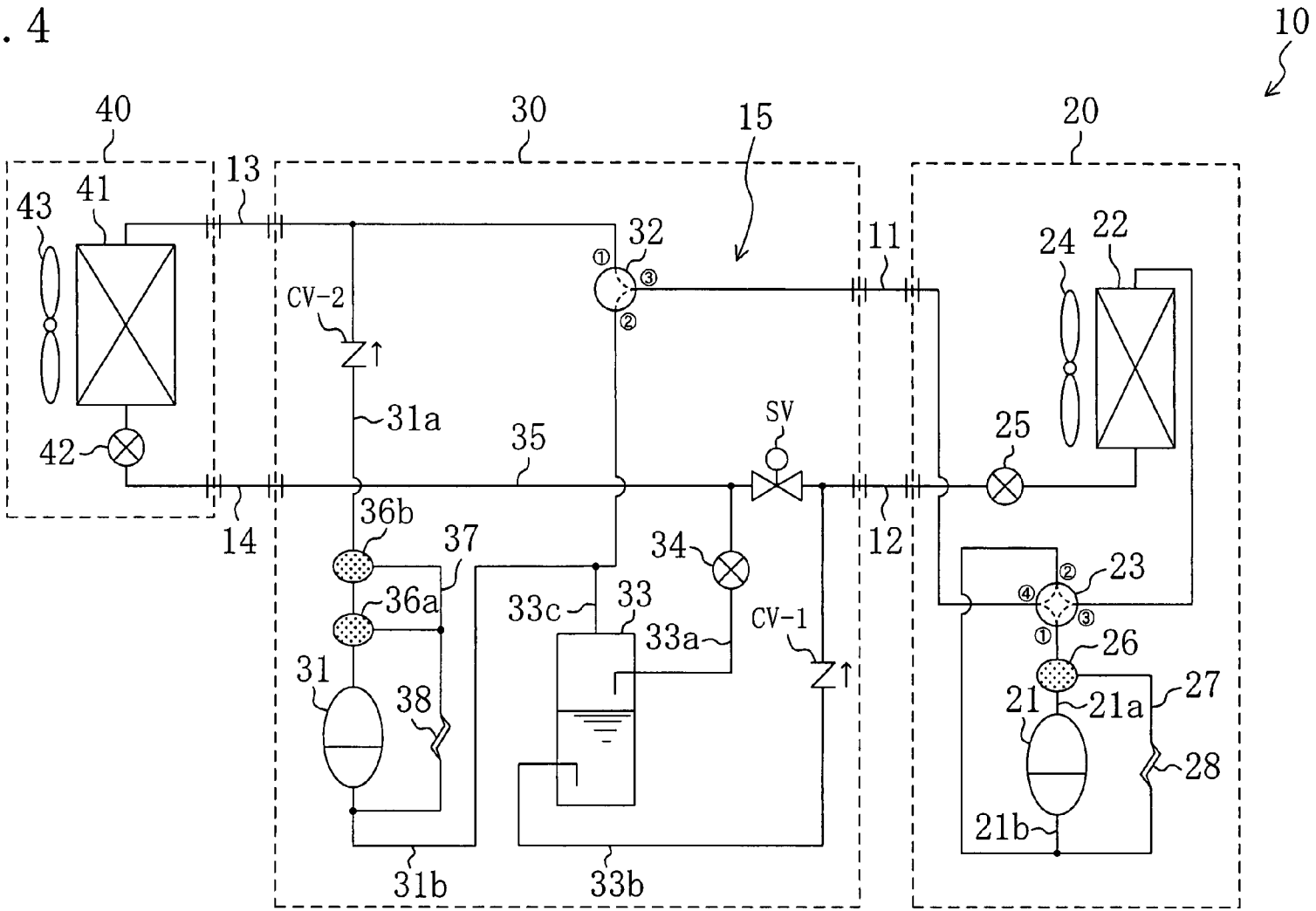
FIG. 4 is a piping diagram showing a refrigerant circuit of a refrigeration system according to a modification of Embodiment 1.

As shown in FIG. 4, this modification is different from Embodiment 1 in the structure of the high-pressure stage oil separating device. Specifically, in this modification, the discharge pipe (31*a*) of the high-pressure stage compressor (31) is provided with two high-pressure stage oil separators (36*a*, 36*b*). Each of these oil separators (36*a*, 36*b*) is constituted by a cyclone oil separator. Two flows of refrigerating machine oil separated out by their respective oil separators (36*a*, 36*b*) meet in the second oil separation pipe (37) and is then returned to the suction side of the high-pressure stage compressor (31).

On the other hand, the discharge pipe (21*a*) of the low-pressure stage compressor (21) is provided, like Embodiment 1, with a single low-pressure stage oil separator (26). In this modification, the high-pressure stage oil separators (36*a*, 36*b*) and the low-pressure stage oil separator (26) have equal capacities.

In this modification, the low-pressure stage oil separating device has a smaller efficiency of oil separation than the high-pressure stage oil separating device because of their difference in the number of oil separators. Like Embodiment 1, this eliminates the deficiency in the amount of oil returned to the high-pressure stage compressor (31) during a two-stage compression and two-stage expansion refrigeration cycle.

Embodiment 2 of the Invention

Figure 5:
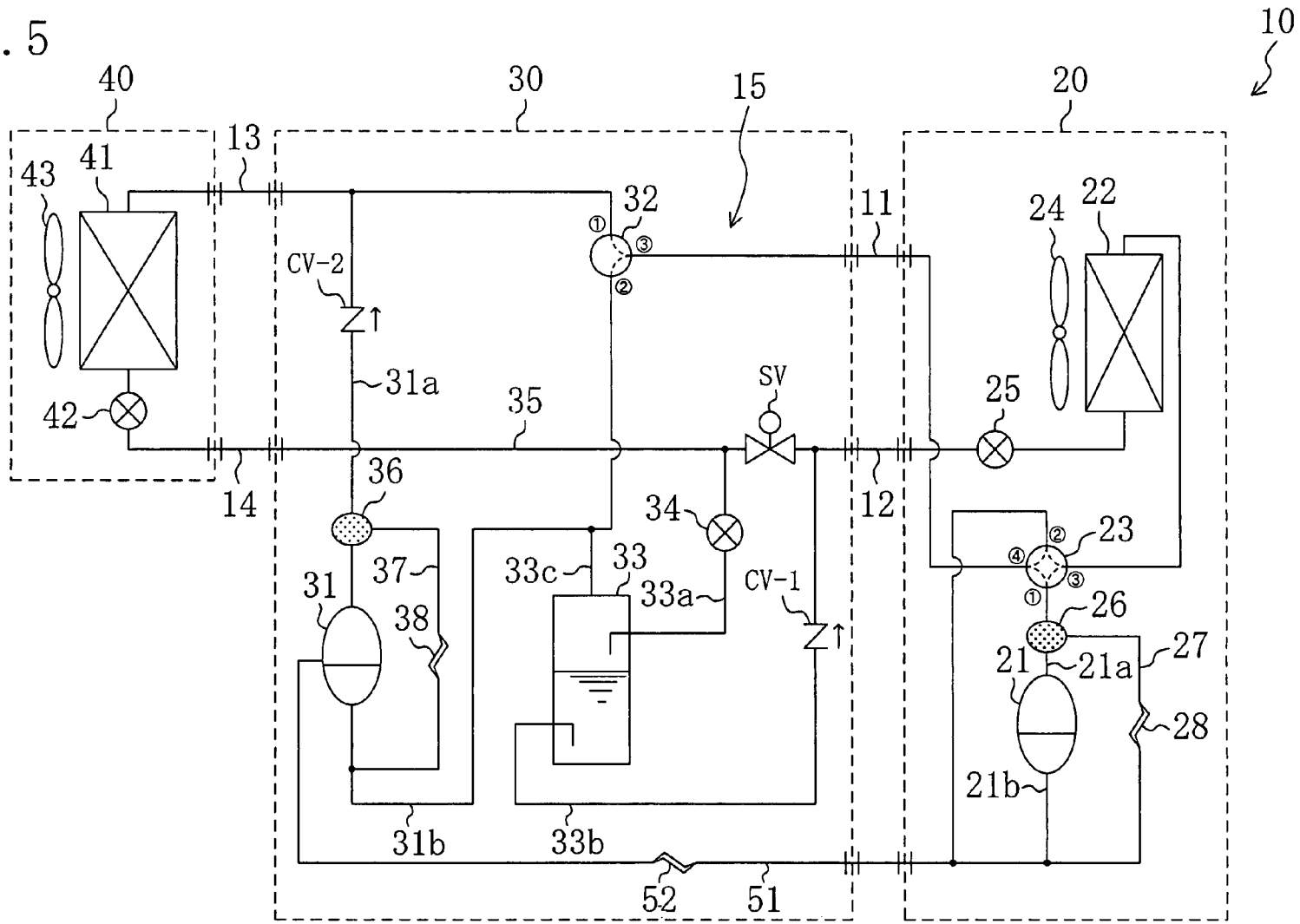
FIG. 5 is a piping diagram showing a refrigerant circuit of a refrigeration system according to Embodiment 2.

As shown in FIG. 5, a refrigeration system according to Embodiment 2 is a refrigeration system in which the refrigerant circuit (15) of the air conditioning system (10) of Embodiment 1 additionally includes an oil return pipe (51) for the high-pressure stage compressor (31). One end of the oil return pipe (51) is connected to the sidewall of the casing of the high-pressure stage compressor (31) and opens into an oil reservoir formed in the casing and at a fixed height of the oil reservoir. On the other hand, the other end of the oil return pipe (51) is connected to the suction pipe (21*b*) of the low-pressure stage compressor (21) in the outdoor unit (20). Furthermore, the oil return pipe (51) is provided with a third capillary tube (52).

As described above, the efficiency of oil separation of the high-pressure stage oil separating device (36, 37, 38) is higher than that of the low-pressure stage oil separating device (26, 27, 28). Therefore, during the heating operation as described above, the refrigerating machine oil for the high-pressure stage compressor (31) might be excessively accumulated in the oil reservoir to gradually raise the oil level and, in turn, the components of the high-pressure stage compressor (31) might be immersed in the refrigerating machine oil. To avoid this, in Embodiment 2, refrigerating machine oil excessively accumulated in the high-pressure stage compressor (31) is returned to the suction side of the low-pressure stage compressor (21).

Specifically, when the refrigerating machine oil in the high-pressure stage compressor (31) becomes excessive to raise the oil level up to the fixed height, an excess amount of refrigerating machine oil therein flows into the oil return pipe (51). The excess refrigerating machine oil is reduced in pressure by the third capillary tube (52) and then sucked into the low-pressure stage compressor (21). As a result, it can be avoided that the oil level in the high-pressure stage compressor (31) excessively rises. Meanwhile, since the oil is actively returned to the high-pressure stage compressor (31), the high-pressure stage compressor (31) is not short of refrigerating machine oil and always holds a fixed oil level.

Modification of Embodiment 2

Figure 6:
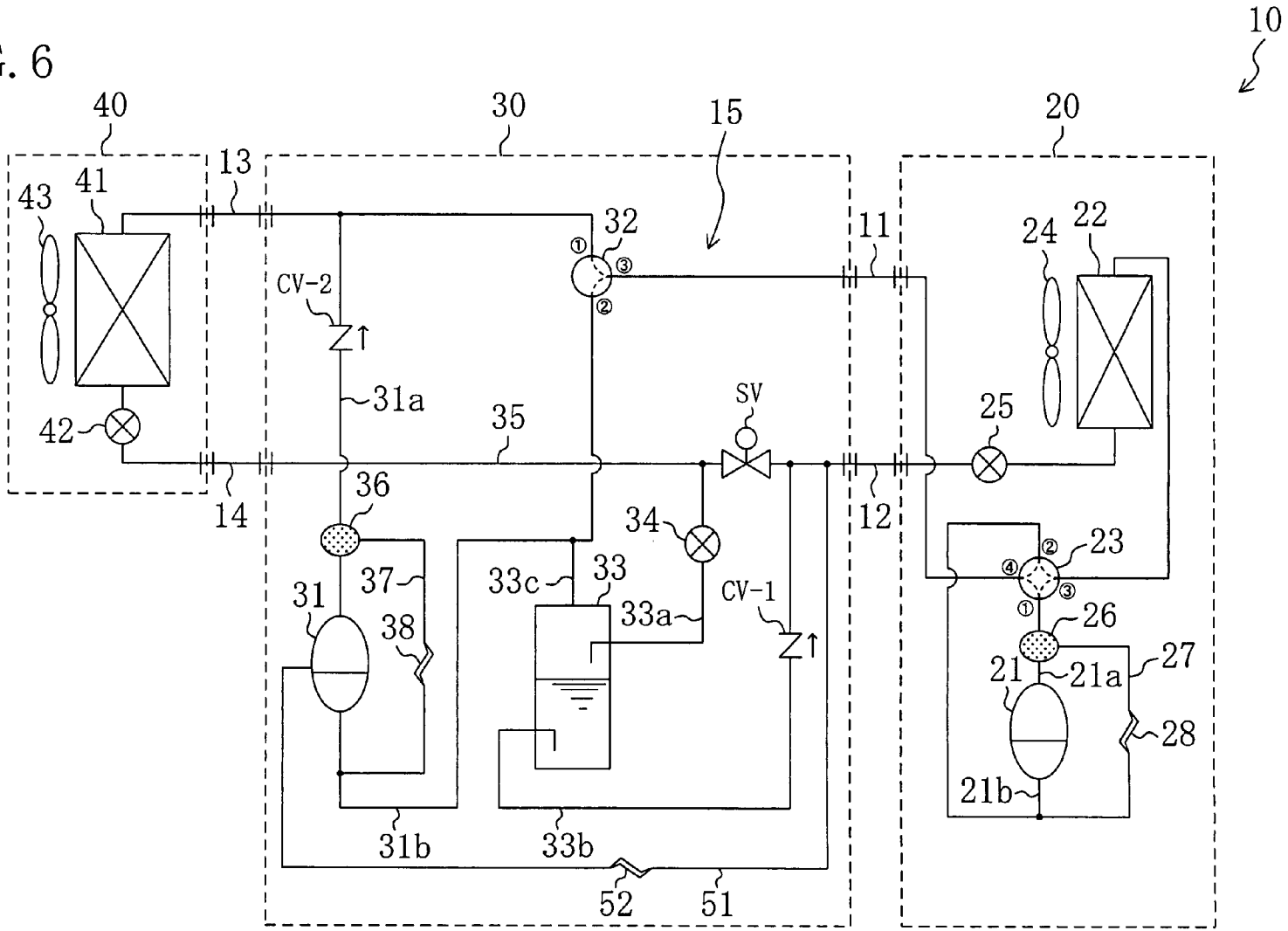
FIG. 6 is a piping diagram showing a refrigerant circuit of a refrigeration system according to a modification of Embodiment 2.

As shown in FIG. 6, this modification is different from Embodiment 2 in the connecting point of the oil return pipe (51). Specifically, in this Modification 2, the other end of the oil return pipe (51) is connected to the outflow end of the second pipe (33*b*) of the gas-liquid separator (33). Therefore, an excess amount of refrigerating machine oil having flowed out of the high-pressure stage compressor (31) to the oil return pipe (51) is mixed with refrigerant having flowed out of the second pipe (33*b*). Thereafter, the refrigerant containing the refrigerating machine oil passes through the outdoor heat exchanger (22) and is then sucked into the low-pressure stage compressor (21).

In this modification, since, unlike Embodiment 2, the oil return pipe (51) is placed in the option unit (30), this facilitates the piping work. More specifically, in the above Embodiment 2, in order to connect a part of the oil return pipe (51) located in the option unit (30) to the suction pipe (21*b*) located in the outdoor unit (20), it is necessary to provide a connection pipe between the option unit (30) and the outdoor unit (20). In contrast, in this modification, there is no need to provide such a connection pipe. Furthermore, according to this modification, in connecting an option unit (30) to an existing outdoor unit (20), there is no need to modify the piping of the outdoor unit (20). In other words, since in this modification the high-pressure stage compressor (31), the gas-liquid separator (33) and the oil return pipe (51) are all placed in the option unit (30), this simplifies the installation of the option unit (30), such as expansion and replacement, and offers an additional function of returning excess refrigerating machine oil in the high-pressure stage compressor (31) to the low-pressure stage compressor (21).

Other Embodiments

The above embodiments may have the following configurations.

In the above embodiments, the refrigerant circuit (15) is formed by connecting an option unit (30) between the outdoor unit (20) and the indoor unit (40). However, the option unit (30) and the outdoor unit (20) may not necessarily be separate units and may be formed as an integrated outdoor unit.

Furthermore, although in the above embodiments a cyclone oil separator or a demister oil separator is used for an oil separating device, any other type of oil separator, such as a wire mesh oil separator, may be used.

Furthermore, although in the above embodiments air is heated and cooled by refrigerant in the utilization side indoor heat exchanger (41), the indoor heat exchanger may be constituted, such as by a plate heat exchanger, to heat and cool water by refrigerant in the indoor heat exchanger.

The above embodiments are merely preferred embodiments in nature and are not intended to limit the scope, applications and use of the invention.

INDUSTRIAL APPLICABILITY

As can be seen from the above description, the present invention is useful for techniques for returning oil to a high-pressure stage compressor in a refrigeration system operating in a two-stage compression and two-stage expansion refrigeration cycle using a gas-liquid separator.

The invention claimed is:

1. A refrigeration system including a refrigerant circuit that includes a low-pressure stage compressor, a high-pressure stage compressor and a gas-liquid separator for intermediate-pressure refrigerant and operates in a two-stage compression and two-stage expansion refrigeration cycle, wherein the refrigerant circuit further includes a low-pressure stage oil separating device for returning refrigerating machine oil separated out of refrigerant discharged from the low-pressure stage compressor to the suction input of the low-pressure stage compressor and a high-pressure stage oil separating device for returning refrigerating machine oil separated out of refrigerant discharged from the high-pressure stage compressor to the suction input of the high-pressure stage compressor, and the rate of oil separated out of refrigerant by the low-pressure stage oil separating device is set lower than the rate of oil separated out of refrigerant by the high-pressure stage oil separating device.

2. The refrigeration system of claim 1, wherein the high-pressure stage oil separating device includes a plurality of oil separators connected in series to the discharge side of the high-pressure stage compressor, and the low-pressure stage oil separating device includes a smaller number of oil separators than the oil separators for the high-pressure stage compressor, the smaller number of oil separators being connected to the discharge side of the low-pressure stage compressor.

3. The refrigeration system of claim 1, wherein the low-pressure stage oil separating device is a cyclone oil separator, and the high-pressure stage oil separating device is a demister oil separator.

4. The refrigeration system of claim 3, wherein the cyclone oil separator has an efficiency of oil separation of approximately 90%, and the demister oil separator has an efficiency of oil separation of approximately 95%.

5. A refrigeration system, comprising:

a refrigerant circuit that operates in a two-stage compression and two-stage expansion refrigeration cycle, the refrigerant circuit including a low-pressure stage compressor, a high-pressure stage compressor, a gas-liquid separator for intermediate-pressure refrigerant, a low-pressure stage oil separating device for returning refrigerating machine oil separated out of refrigerant discharged from the low-pressure stage compressor to the suction side of the low-pressure stage compressor, and a high-pressure stage oil separating device for returning refrigerating machine oil separated out of refrigerant discharged from the high-pressure stage compressor to the suction side of the high-pressure stage compressor, wherein the efficiency of oil separation of the low-pressure stage oil separating device is set lower than the efficiency of oil separation of the high-pressure stage oil separating device, an oil reservoir for the refrigerating machine oil is formed in the casing of the high-pressure stage compressor, and the refrigerant circuit further includes an oil return pip; one end of which is connected to the casing of the high-pressure stage compressor to open into the oil reservoir at a fixed height of the oil reservoir, and the other end of which is connected to the suction side of the low-pressure stage compressor.

6. A refrigeration system, comprising:

a refrigerant circuit that operates in a two-stage compression and two-stage expansion refrigeration cycle, the refrigerant circuit including a low-pressure stage compressor, a high-pressure stage compressor, a gas-liquid separator for intermediate-pressure refrigerant, a low-pressure stage oil separating device for returning refrigerating machine oil separated out of refrigerant discharged from the low-pressure stage compressor to the suction side of the low-pressure stage compressor, and a high-pressure stage oil separating device for returning refrigerating machine oil separated out of refrigerant discharged from the high-pressure stage compressor to the suction side of the high-pressure stage compressor, wherein the efficiency of oil separation of the low-pressure stage oil separating device is set lower than the efficiency of oil separation of the high-pressure stage oil separating device, an oil reservoir for the refrigerating machine oil is formed in the casing of the high-pressure stage compressor, and the refrigerant circuit further includes an oil return pip; one end of which is connected to the casing of the high-pressure stage compressor to open into the oil reservoir at a fixed height of the oil reservoir, and the other end of which is connected to an outflow side of the gas-liquid separator through which liquid refrigerant flows out.

7. The refrigeration system of claim 6, wherein the refrigerant circuit is formed by connecting an outdoor unit including the low-pressure stage compressor and an outdoor heat exchanger, an indoor unit including an indoor heat exchanger, and an option unit including the high-pressure stage compressor, the gas-liquid separator and the oil return pipe to each other by piping.

* * * * *